US011211190B2

(12) United States Patent
Sobczak et al.

(10) Patent No.: US 11,211,190 B2
(45) Date of Patent: Dec. 28, 2021

(54) COVER FOR A DISTRIBUTION TRANSFORMER FILLED WITH A DIELECTRIC LIQUID

(71) Applicant: HITACHI ENERGY SWITZERLAND AG, Baden (CH)

(72) Inventors: Witold Sobczak, Pabianice (PL); Pawel Klys, Lodz (PL); Max Claessens, Untersiggenthal (CH); Filip Grecki, Cracow (PL); Pawel Aloszko, Cracow (PL); Lukasz Bachorz, Cracow (PL); Krzysztof Obrebski, Warsaw (PL); Marcin Czopek, Cracow (PL)

(73) Assignee: HITACHI ENERGY SWITZERLAND AG, Baden (CH)

( * ) Notice: Subject to any disclaimer, the term of this patent is extended or adjusted under 35 U.S.C. 154(b) by 437 days.

(21) Appl. No.: 16/299,777

(22) Filed: Mar. 12, 2019

(65) Prior Publication Data

US 2019/0206605 A1 Jul. 4, 2019

Related U.S. Application Data

(63) Continuation of application No. PCT/EP2017/000944, filed on Aug. 1, 2017.

(30) Foreign Application Priority Data

Sep. 12, 2016 (EP) ..... 16460066

(51) Int. Cl.
*H01F 27/04* (2006.01)
*H01F 27/14* (2006.01)
(Continued)

(52) U.S. Cl.
CPC ..... *H01F 27/12* (2013.01); *H01F 27/025* (2013.01); *H01F 27/04* (2013.01); *H01F 27/402* (2013.01);
(Continued)

(58) Field of Classification Search
CPC ..... H01F 27/12; H01F 27/402; H01F 27/025; H01F 27/04; H01F 27/14; H01F 2027/404
See application file for complete search history.

(56) References Cited

U.S. PATENT DOCUMENTS 2,990,528 A * 6/1961 Zimsky ..... H01F 27/33 336/58
3,235,823 A 2/1966 Renberg, Jr.
(Continued)

FOREIGN PATENT DOCUMENTS

CN 2354276 Y 12/1999
CN 204117770 U 1/2015
(Continued)

OTHER PUBLICATIONS

European Patent Office, International Search Report & Written Opinion issued in corresponding Application No. PCT/EP2017/000944, dated Nov. 24, 2017, 12 pp.
(Continued)

*Primary Examiner* — Tuyen T Nguyen
(74) *Attorney, Agent, or Firm* — Sage Patent Group

(57) ABSTRACT

The subject of the present application is a cover for distribution transformer filled with a dielectric liquid, equipped with electronic device integrated with the cover which is applied for transmission and distribution of electric energy. The cover is characterized in that the electronic device is immersed in the dielectric liquid filling a cooling compartment fixed on the cover; the cooling compartment has side walls, a top wall and a bottom wall which bottom wall is matched in the window made in the cover and the bottom wall forms a thermal barrier between the interior of the electric power device and the interior of the cooling compartment and the both interiors of the cooling compartment
(Continued)

Figure 1:
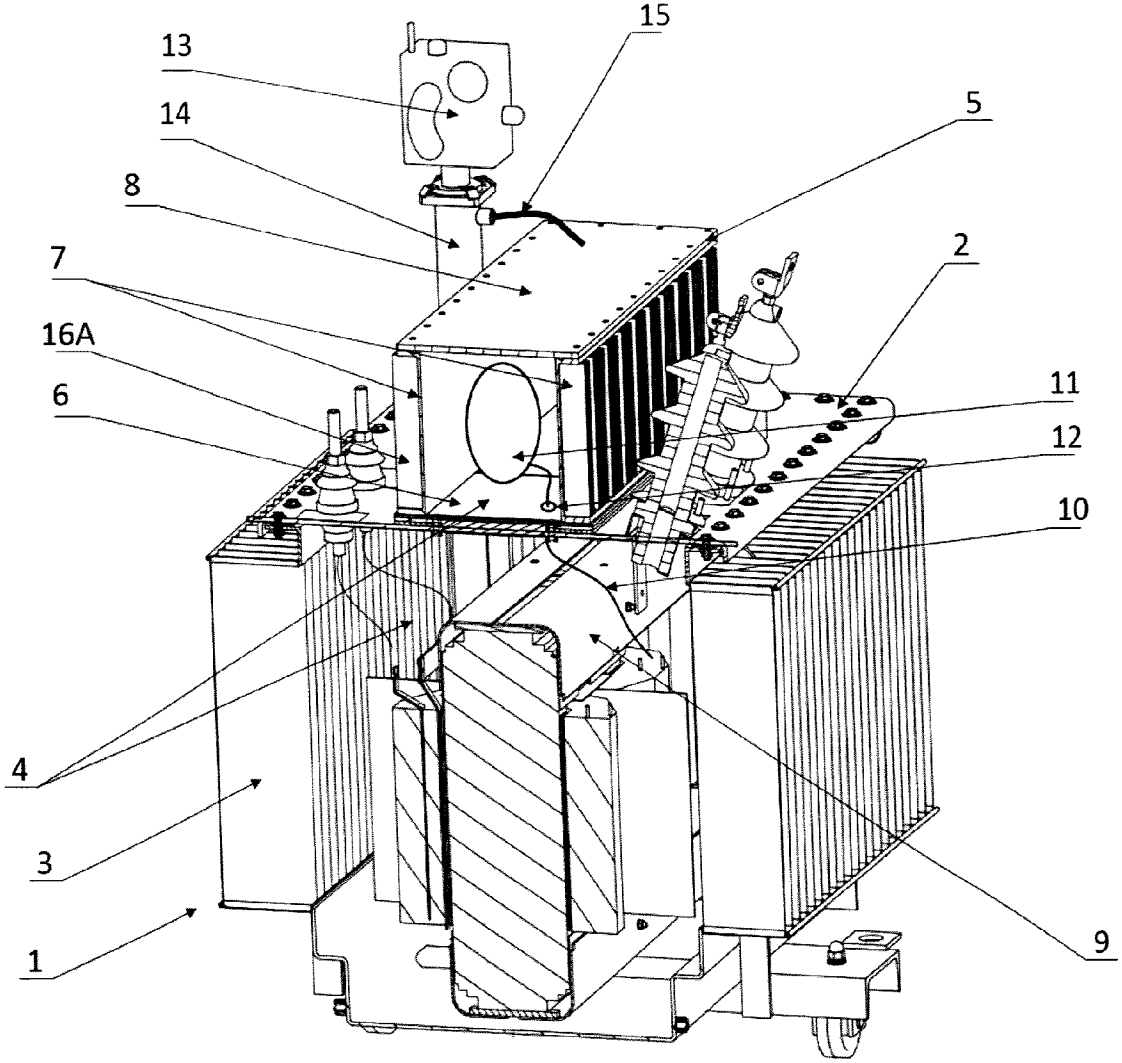

and of the electric power device are hermetically closed together.

20 Claims, 3 Drawing Sheets

(51) Int. Cl.
*H01F 27/12* (2006.01)
*H01F 27/02* (2006.01)
*H01F 27/40* (2006.01)

(52) U.S. Cl.
CPC ..... *H01F 27/14* (2013.01); *H01F 2027/404* (2013.01)

(56) References Cited

U.S. PATENT DOCUMENTS

| | | | | |
|---|---|---|---|---|
| 8,648,587 | B2 | 2/2014 | Brueckl et al. | |
| 2012/0242443 | A1* | 9/2012 | Magnier | H01H 9/0005 336/90 |
| 2015/0380782 | A1 | 12/2015 | Youngs et al. | |
| 2016/0195891 | A1 | 7/2016 | Divan et al. | |
| 2016/0322151 | A1* | 11/2016 | Larsson | H01F 27/004 |

FOREIGN PATENT DOCUMENTS

| | | | |
|---|---|---|---|
| CN | 204441030 | U | 7/2015 |
| CN | 105206381 | A | 12/2015 |
| CN | 204948615 | U | 1/2016 |
| EP | 3048623 | A1 | 7/2016 |
| KR | 101163422 | B1 | 7/2012 |
| WO | 2015010753 | A1 | 1/2015 |

OTHER PUBLICATIONS

European Patent Office, Extended Search Report issued in corresponding Application No. 16460066.0, dated Mar. 17, 2017, 10 pp.
First Examination Report, Indian Patent Application No. 201947013985, dated Jun. 1, 2020, 6 pages.
Search Report, Chinese Patent Application No. 2017800697690, dated Dec. 14, 2020, 2 pages.

* cited by examiner

COVER FOR A DISTRIBUTION TRANSFORMER FILLED WITH A DIELECTRIC LIQUID

The subject of the invention is a cover for a distribution transformer filled with a dielectric liquid, equipped with electronic means integrated with the cover which is applied for transmission and distribution of electric energy.

Within equipment for transmission and distribution of electric energy very often liquids are used for electrical insulation as well as for cooling purpose. In power, distribution and instrument transformers usually mineral oil becomes applied, but also biodegradable and low-flammable synthetic or natural ester oils. Due to the electrical losses in magnetic materials, induced eddy currents in steel parts and ohmic losses in the conductors, those liquids may reach temperatures in full load operation of 100° C. or even more, for example in the upper region of the transformer (so called top-oil temperature). When temperature sensitive components become integrated into the apparatus, for example electronics, sensors or communication devices, those temperatures may decrease their lifetime massively. Therefore it is desirable to integrate such elements in a way, that considerable lower temperatures are present in the region of such components. The solution of this problem is solved by the cover according to the invention.

From patent application WO 2015/010753 there is known a cover with an electrical lead through connector for connecting MV or HV conductor with a load placed in a tank containing a dielectric liquid or dielectric gas. An electrical lead through connector comprises a plug-in bushing member made of insulating material, where a series filtering choke is embedded. The filtering choke has a first terminal which is electrically connected with an external HV or MV line and has a second terminal which is connected to a load placed inside the tank. The lead through connector is further provided with an additional bushing member which is mechanically connected with the plug-in bushing member through a common insulating base. The additional bushing member is equipped with a conductor located inside the bushing member, where the conductor is directly connected with the second terminal of the filtering choke and with an external protective component against electrical surges. This solution said nothing concerning the electronic equipment situated external to the tank and having electrical connections with the load placed inside the tank. There is a need to provide a technical solution to the oil immersed distribution transformer or some other oil immersed power product connected with the electronic device where the electronic devices are immersed in the oil having lower critical level of working temperature than temperature the oil inside the tank of the transformer.

From U.S. Pat. No. 3,235,823 there is known a HV three phase transformer having a cover to which a mechanical tap changer device is connected under the external surface of the cover. The tap changer is immersed in the oil filled the tank of the transformer and has an electrical connection with an active part of the transformer. The tap changer is placed in the upper part of the transformer under the cover. The cover is divided into three integrally-united covers and each cover is generally box like in shape and has an openings at the lower end. The interior space under the cover can be regarded as an upper cooling compartment. In the mentioned U.S. Pat. No. 3,235,823 there is no information about thermal barrier between upper and lower compartment of the transformer. Patent is saying about separation of HV transformer tank for smaller compartments which can be sealed for transportation purposes. There is no information about having compartment with thermal barrier to achieve the lower temperature of the fluid inside the upper compartment. In U.S. Pat. No. 3,235,823 the upper compartment is fulfilled with oil however there is no information about temperature gradient of the oils in separate compartments (upper and lower) what is the main feature of cooling compartment described in subjected invention.

From U.S. Pat. No. 8,648,587 there is known a combination of a tap changer at a regulating transformer. The regulating transformer is a local mains transformer or a consumer-proximal distribution transformer. The regulating transformer comprises an oil-filed vessel in which at least one yoke and windings of the regulating transformer are disposed. The tap-changer comprises a mechanical contact system for selection of a tap of regulating winding of the regulating transformer as well as a load changeover switch for actual on-load switching. The mechanical contact system of the tap changer is in the vessel below the transformer cover and above the yoke. The load changeover switch is outside the vessel above the transformer cover and comprises thyristors or IGBTs. The load changeover switch and mechanical contact system of the tap changer are separated from one another by a horizontal insulation lead-trough plate. So the electronic components can be operated in air and the mechanical contact system can be operated in oil. This solution presents the electronic equipment situated external to the tank and having electrical connections with the load placed inside the tank but the solution said nothing about the electronic devices which are immersed in the oil together with the mechanical systems. This solution said nothing about the cooling of the electronic devices in the oil having lower critical level of working temperature than temperature the oil inside the tank of the transformer. So there is a need to provide a technical solution to the oil immersed distribution transformer or some other oil immersed power product connected with the electronic device, especially the electronic devices belongs to a tap-changer where the electronic devices are immersed in the oil having lower critical level of working temperature than temperature the oil inside the tank of the transformer.

An essence of a cover for covering a distribution transformer wherein the distribution transformer is filled with a dielectric liquid in which the active part of the distribution transformer is placed and the cover has a cooling compartment located at its an upper part, wherein the cooling compartment has side walls and a top wall, is that the cover is equipped with a window in which a bottom wall of the cooling compartment is inserted and matched by a chamfer disposed on entirely circumference of the bottom wall. The bottom wall forms a thermal barrier between the interior of a main tank of the distribution transformer and the interior of the cooling compartment. The both interiors of the cooling compartment and of the main tank of the distribution transformer are hermetically closed together when filled with the dielectric liquid. In the dielectric liquid filling the cooling compartment at least one electronic device is placed having an electrical connection with the active part of the distribution transformer.

Preferably the thermal barrier is made from a high thermal resistive material having a coefficient of the thermal conductivity not higher than 0.24 W/(m*K).

Preferably the bottom wall of the cooling compartment is provided with at least one through hole for insertion in it a conductor for electrical connection of the electronic device with the active part of the distribution transformer.

Preferably the cooling compartment is connected with an oil filling pipe of the main tank of the distribution transformer via a flexible pipe and a protection device is installed on the filling pipe, for measuring of a level of the dielectric liquid inside the cooling compartment.

Preferably at least one side wall of the cooling compartment is equipped with external ribs.

Preferably the top wall of the cooling compartment is equipped with external ribs.

A cover according to claim 1-7 is characterized in that the electronic device is a tap-changer placed in the cooling compartment.

Preferably the tap-changer device is connected with the active part of the distribution transformer through the conductor placed in the hole made in the bottom wall of the cooling compartment.

The cover according to the invention enables to integrate thermal sensitive devices like electronic or power electronic device with oil immersed power products like distribution transformer without need of hermetically insulation of separate compartments with dielectric liquids. Such arrangement of separate oil volume compartments is less costly and less difficult to applicate on the electric power device than expensive connection of two totally separated and sealed fluid volumes connected by the expensive MV bushings and MV power cables. The invention removes the problems with sealing compartments and the problems with the insulation of leads of the conductors provided from electronic device to the active part of the power product such as transformer. In proposed solution the time consuming processes of carried out the special insulation of the leads and bushing joints can be omitted. Using the thermal barrier as a common part of the cover and the cooling compartment allows for differentiation the temperature of the dielectric liquids filled the main transformer tank and the cooling compartment. Additional the external ribs provided on the cooling compartment lead to an improvement of the cooling conditions.

Figure 2:
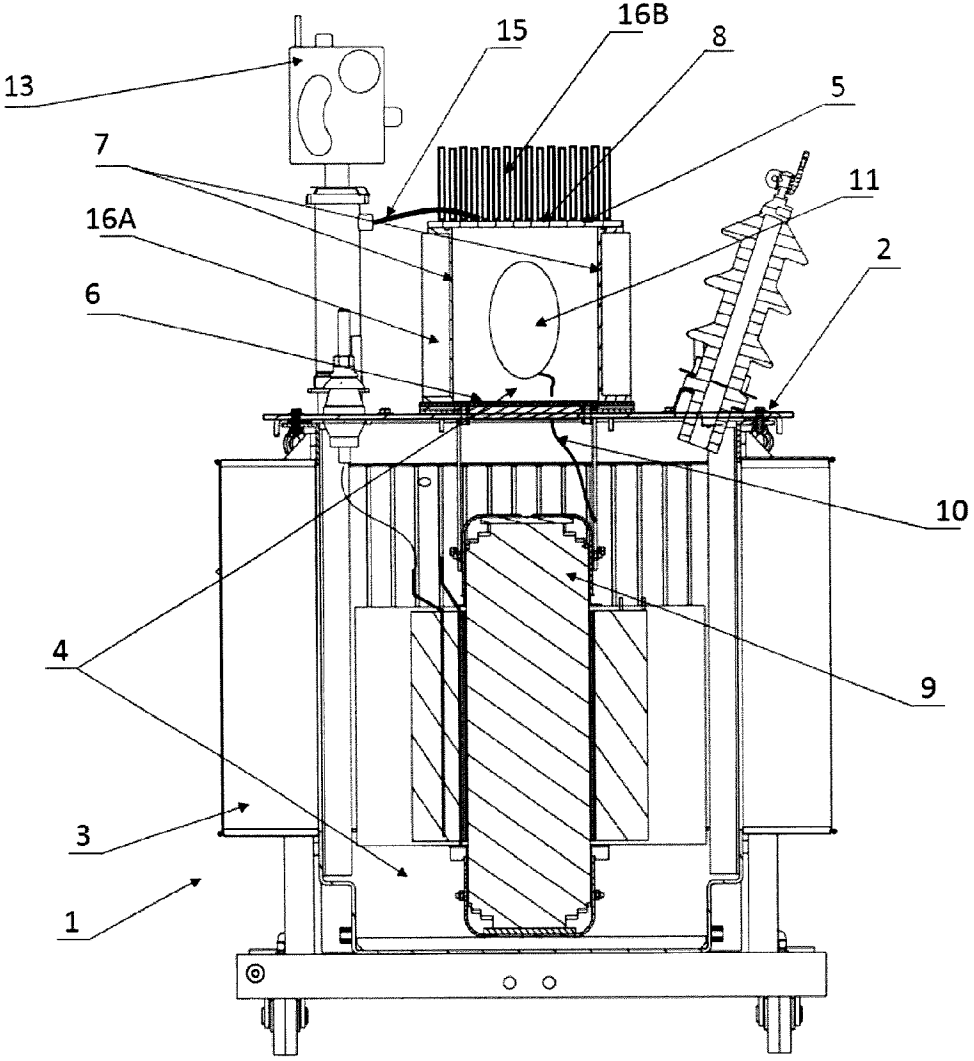
Figure 3:
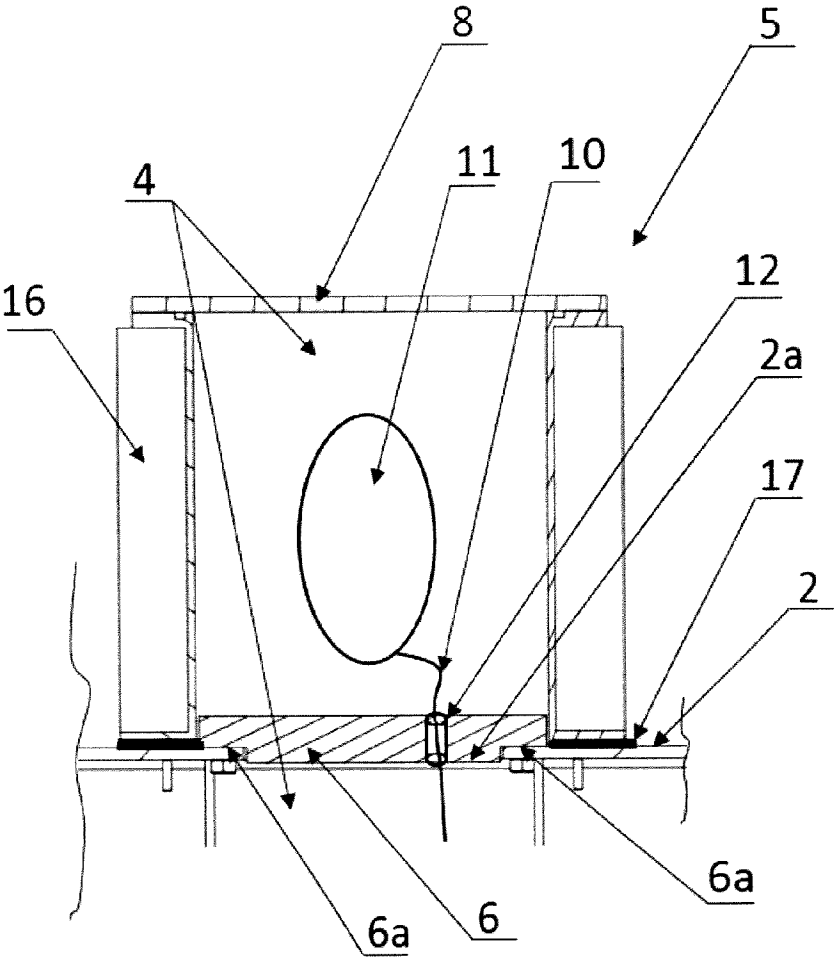

The present invention is present in the exemplary embodiment in the drawing where:

FIG. 1 shows a distribution transformer in the first of the embodiment of the invention, having a cover equipped with electronic devices enclosed in the cooling compartment, in an axonometric view with open cross-section over the transformer, FIG. 2 shows a distribution transformer in the second of the embodiment of the invention, having a cover equipped with electronic devices enclosed in the cooling compartment, in cross-section of the plain view, FIG. 3 shows a part of the transformer from FIG. 1, concerning the thermal barrier of a cooling compartment, which is fixed to the transformer cover, in cross-section of the plain view.

An electric power device in the form of a distribution transformer 1 has a cover 2 connected to the main tank 3 filled with the oil 4. The oil 4 could be a mineral oil, synthetic oil, ester oil and other dielectric liquid. The oil is not indicated on the drawing in a special style. Only the index "4" indicates where the oil is placed. The cover 2 is equipped with a window 2*a* (FIG. 3) in which an external cooling compartment 5 is inserted through a bottom wall 6 of the compartment 5. In order to match the bottom wall 6 into the window 2*a* of the cover 2, the bottom wall 6 is equipped with a chamfer 6*a* (FIG. 3) disposed on the entirely circumference of the bottom wall 6. The cooling compartment 5 is equipped with four side walls 7 and a top wall 8, forming a rectangular vessel fixed on the cover 2. Inside the main tank 3 an active part 9 of the transformer is placed having windings electrically connected with MV bushings and with the electric connection of LV terminals. The active part 9 is also connected by an elastic conductors 10 with electronic devices 11 placed inside the cooling compartment 5. The electronic devices are presented schematically in the drawing as an oval. In order to connect the conductors 10 with the active part 9 of the transformer some holes 12 are made in the bottom wall 6 of the compartment 5. The cooling compartment 5 is filled with oil 4 or other dielectric liquid useful for transformers, the same as filled the main tank 3 so the main transformer tank 3 is hermetically connected with the cooling compartment 5. The device 11 immersed in fluid in cooling compartment can be power electronic tap changer or any other electronic devices connected to active part of the distribution transformer. The bottom wall 6 of the cooling compartment 5 is fixed to the cover 2 in such a way that the oil 4 can flow through holes 12 to the cooling compartment from the main tank 3 and vice versa. The holes 12 are designed in such a way that each of the hole has such a dimension that allows for insertion in it the flexible conductor 10 without using any sealing in each of the hole 12. Such arrangement leaves the interior of the cooling compartment 5 open to the oil 4 from the tank 3 and there is no need for hermetically insulation. The level of the oil 4 in the cooling compartment 5 is indicated by standard protection device 13 for measuring a level and the pressure of the dielectric liquid 4 inside the cooling compartment 5, for example Integrated Safety Detector (R.I.S.), connected with the oil 4 located in the oil filing pipe 14 and through a flexible pipe 15, fixed to the top wall 8 of the cooling compartment 5. When the level of the oil in the cooling compartment 5 is dropped below a threshold level then the protection device 13 is triggered and the electric power device 1 is disconnected from the grid to avoid transformer damage. The bottom wall 6 of the cooling compartment 5 forms a thermal barrier between an interior of the main tank 3 and the interior of the cooling compartment 5, where the power electronic devices 11 together with the mechanical systems, not presented in the drawing are placed. In order to form a thermal barrier between the main tank 3 and the external cooling compartment 5, the bottom wall 6 is made from a high thermal resistive material having a coefficient of the thermal conductivity not higher than 0.24 W/(m*K). In the exemplary embodiments of the invention, the bottom wall 6 is made from semi-crystalline thermoplastic polyester having the thermal and electrical properties presented in the table 1.

TABLE 1

| Parameter | Value | Unit |
|---|---|---|
| Density | 1.37 | $g/cm^3$ |
| Max. service temp. (short term) | 170 | ° C. |
| Max. service temp. (long term) | 110 | ° C. |
| Coefficient of thermal conductivity | 0.24 | W/(m * K) |
| Specific heat | 1.1 | J/(g * K) |
| Surface resistance | $10^{15}$ | Ω |
| Dielectric strength 1 mm | 60 | kV/mm |

The cooling compartment 5 with the bottom wall 6 as the thermal barrier between the interior of the main thank 3 and the interior of the cooling compartment 5 is also equipped with additional ribs 16 adapted for the oil heat dissipation and presented in the first and second embodiment of the invention.

In the first embodiment of the invention at least one of the side walls 7 of the enclosure 5 is equipped with external ribs 16. The ribs have longitudinal shape 16A what is presented in the drawing for the two side walls 7 of the cooling compartment 5. The other shapes of the ribs 16 are possible and there many of its are known in the prior art. The side walls 7 of the cooling compartment 5 are made from material having a high ability to give up the heat, for example from aluminum or the black anodized aluminum. The ribs 16A can be made as integral part of the walls 7 or can be fixed to the walls as separate parts. The ribs are made from the same material as the walls of the compartment or from other material having the higher ability to give up the heat than the walls. The side walls 7 can also be carried out as the corrugated walls what is not presented in the drawing.

In the second embodiment of the invention the top wall 8 of the cooling compartment 5 is also equipped with external ribs 16. The ribs on the top wall 8 have cylindrical shape 16B and they are displaced on the wall in any arbitrary arrangements. The other shapes of the ribs are possible and there many of its are known in the prior art. The top wall 8 of the cooling compartment 5 is made from material having a high ability to give up the heat, for example from aluminum or the black anodized aluminum. The ribs 16B can be made as integral part of the wall 8 or can be fixed to the wall as separate parts. The ribs 16B are made from the same material as the top wall 8 of the compartment 5 or from other material having the higher ability to give up the heat than the top wall.

In both embodiment of the invention the cover 2 has others openings for inserting there bushings with conductors, placed outside the bottom wall 6 of the cooling compartment 5, what is not presented in the drawing. In order to avoid a movement of the thermal barrier inside the window 2*a,* additional tie rods and nuts made from fiber glass are fixed to the cover 2, what is not explained in the description. Between transformer cover 2 and cooling compartment 5 a rubber flat seal 17 is inserted in order to seal the cooling compartment from the external side of the cover 2.

In the exploitation condition of the invention, the cover 2 with the thermal barrier in the form of the bottom wall 6 of the cooling compartment 5, works as the following. Inside cooling compartment 5 the electronic devises 11 are placed. The electronic devices could be for example the electronic boards contain thyristors, IGBT's or any other power electronic solid state valves. Such electronic devices should have no more than +75° C. maximum operation temperature in order to ensure sufficient reliability for 20 years operation. The hot oil 4 in the main tank 3 can reach temperatures up to 100° C. under full load conditions. The ambient air outside the transformer could reach up to +40° C. In the consequence the temperature inside the cooling compartment 5 may be established in a level between those two values. However the electronic boards generate additional load losses mainly because of the work of thyristors. The heat fluxes strongly depend on the dimensioning of the cooling ribs 16A , 16B and the dimension of the bottom wall 6 forming the thermal barrier. The barrier allows to isolate oil from hot top oil in the main tank 3 into separate compartment where oil has the lower temperature. A high temperature gradient is provided along the cross-section of the thermal barrier. Generally, the area of the holes 12 made in the bottom wall 6 of the compartment 5 should be as low as possible for limiting the oil mixing of the hot top oil from the main tank 3 with the cool oil from the cooling compartment 5, whereas the area between cool compartment 5 and ambient air should be vice versa. It is possible to limit the oil temperature inside the cool compartment 5 to around 72° C. in such presented conditions. Heat dissipation by walls 7 and 8 of the cooling compartment 5 with ribs 16 is much more significant that heat transfer from the hot top oil via thermal barrier. As a result the temperature of the oil inside the cooling compartment 5 is much lower than the top temperature of the oil in the main tank 3.

The invention claimed is:

1. A cover for covering a distribution transformer filled with a dielectric liquid in which an active part of the distribution transformer is placed; the cover comprising: a cooling compartment located at an upper part of the cover, wherein the cooling compartment has side walls and a top wall, wherein the cover is equipped with a window in which a bottom wall of the cooling compartment is inserted and matched by a chamfer disposed on the entirely circumference of the bottom wall and the bottom wall forms a thermal barrier between the interior of a main tank of the distribution transformer and the interior of the cooling compartment and the both interiors of the cooling compartment and of the main tank are hermetically closed together when filled with the dielectric liquid and in the dielectric liquid filling the cooling compartment at least one electronic device is placed having an electrical connection with the active part of the distribution transformer.

2. The cover according to claim 1, wherein the thermal barrier is made from a high thermal resistive material having a coefficient of the thermal conductivity not higher than 0.24 W/(m*K).

3. The cover according to claim 1, wherein the bottom wall of the cooling device is provided with at least one through hole for insertion in it a conductor for electrical connection of the electronic device with the active part of the distribution transformer.

4. The cover according to claim 1, wherein the cooling compartment is connected with an oil filling pipe of the main tank of the distribution transformer via a flexible pipe and a protection device is installed on the filling pipe, for measuring of a level of the dielectric liquid inside the cooling compartment.

5. The cover according to claim 1, wherein the at least one side wall of the cooling compartment is equipped with external ribs.

6. The cover according to claim 1, wherein the top wall of the cooling compartment is equipped with external ribs.

7. The cover according to claim 1, wherein the electronic device is a tap-changer device placed in the cooling compartment.

8. A combination, comprising:

a cover for covering a distribution transformer filled with a dielectric liquid in which an active part of the distribution transformer is placed, the cover has a cooling compartment located at an upper part of the cover, wherein the cooling compartment has side walls and a top wall, wherein the cover is equipped with a window in which a bottom wall of the cooling compartment is inserted and matched by a chamfer disposed on the entirely circumference of the bottom wall and the bottom wall forms a thermal barrier between the interior of a main tank of the distribution transformer and the interior of the cooling compartment and both interiors of the cooling compartment and of the main tank are hermetically closed together when filled with the dielectric liquid and in the dielectric liquid filling the cooling compartment at least one tap changer is placed having an electrical connection with the active part of the distribution transformer, the electrical connection is made by a conductor passing through a hole in the bottom wall of the cooling compartment.

9. The cover according to claim 2, wherein the bottom wall of the cooling device is provided with at least one through hole for insertion in it a conductor for electrical connection of the electronic device with the active part of the distribution transformer.

10. The cover according to claim 9, wherein the cooling compartment is connected with an oil filling pipe of the main tank of the distribution transformer via a flexible pipe and a protection device is installed on the filling pipe, for measuring of a level of the dielectric liquid inside the cooling compartment.

11. The cover according to claim 2, wherein the cooling compartment is connected with an oil filling pipe of the main tank of the distribution transformer via a flexible pipe and a protection device is installed on the filling pipe, for measuring of a level of the dielectric liquid inside the cooling compartment.

12. The cover according to claim 3, wherein the cooling compartment is connected with an oil filling pipe of the main tank of the distribution transformer via a flexible pipe and a protection device is installed on the filling pipe, for measuring of a level of the dielectric liquid inside the cooling compartment.

13. The cover according to claim 2, wherein the top wall of the cooling compartment is equipped with external ribs.

14. The cover according to claim 3, wherein the top wall of the cooling compartment is equipped with external ribs.

15. The cover according to claim 4, wherein the top wall of the cooling compartment is equipped with external ribs.

16. The cover according to claim 5, wherein the top wall of the cooling compartment is equipped with external ribs.

17. The cover according to claim 9, wherein the top wall of the cooling compartment is equipped with external ribs.

18. The cover according to claim 2, wherein the electronic device is a tap-changer device placed in the cooling compartment.

19. The cover according to claim 3, wherein the electronic device is a tap-changer device placed in the cooling compartment.

20. The cover according to claim 4, wherein the electronic device is a tap-changer device placed in the cooling compartment.

* * * * *